US010436561B2

(12) United States Patent
Rose et al.

(10) Patent No.: US 10,436,561 B2
(45) Date of Patent: Oct. 8, 2019

(54) FUSE ASSEMBLY FOR A MUNITION

(71) Applicant: 3RD LIGHT LIMITED, Reading (GB)

(72) Inventors: James Rose, Reading (GB); John Perriam, Reading (GB); James McAdam, Godalming (GB)

(73) Assignee: 3RD LIGHT LIMITED, Reading (GB)

( * ) Notice: Subject to any disclaimer, the term of this patent is extended or adjusted under 35 U.S.C. 154(b) by 0 days.

(21) Appl. No.: 16/080,270

(22) PCT Filed: Feb. 13, 2017

(86) PCT No.: PCT/GB2017/050374

§ 371 (c)(1),
(2) Date: Aug. 27, 2018

(87) PCT Pub. No.: WO2017/149270

PCT Pub. Date: Sep. 8, 2017

(65) Prior Publication Data

US 2019/0049224 A1 Feb. 14, 2019

(30) Foreign Application Priority Data

Mar. 3, 2016 (GB) ..... 1603695.6

(51) Int. Cl.
*F42C 14/02* (2006.01)
*F42B 3/117* (2006.01)
*F42B 12/48* (2006.01)

(52) U.S. Cl.
CPC ..... *F42C 14/02* (2013.01); *F42B 3/117* (2013.01); *F42B 12/48* (2013.01)

(58) Field of Classification Search
CPC .. F42C 14/00; F42C 14/02; F42B 3/10; F42B 3/117; F42B 12/48

(Continued)

(56) References Cited

U.S. PATENT DOCUMENTS 2,393,861 A * 1/1946 Miller ..... F42B 3/117 102/487
2,903,534 A * 9/1959 Bleakney ..... F42C 15/40 102/264

(Continued)

FOREIGN PATENT DOCUMENTS

GB 158004 2/1921
GB 837766 A * 6/1960 ..... F42C 14/02
GB 1037240 A * 7/1966 ..... F24C 1/06

OTHER PUBLICATIONS

PCT International Search Report for PCT International Patent Application No. PCT/GB2017/050374, dated Apr. 24, 2017.

*Primary Examiner* — John Cooper
(74) *Attorney, Agent, or Firm* — Holland & Hart LLP

(57) ABSTRACT

A fuse mechanism for e.g. a pyrotechnic grenade in which a spring loaded striker lever (31) is blocked via a cammed surface (22) of a safety lever (21) comprising a handle. (25). Release of the handle (25) enables deployment of the fuse assembly. Spring-loaded striker lever (31) is urged upwards by the force of torsion spring (38). Contact between the free end (34) of the striker lever (31) exerts a rotational force on cammed portion (22). The safety lever (21) rotates away from the body of the munition (20). Rapid upward movement of the striker lever (31) is prevented at this stage by contact of the free end (34) with the cammed portion (22). Further rotation of the safety lever (21) occurs until point where the cammed portion (22) is no longer in contact with the striker lever. Ultimately, once the safety lever (21) has rotated beyond a certain extent, the free end of the striker lever (31) is no longer in contact with the cammed portion (22), and the striker lever is urged rapidly away from the body of the munition (20).

12 Claims, 6 Drawing Sheets

(58) Field of Classification Search
USPC ..... 102/334, 368, 482, 486, 487, 491, 498, 102/499, 204
See application file for complete search history.

(56) References Cited

U.S. PATENT DOCUMENTS

| | | | | | |
|---|---|---|---|---|---|
| 2,965,029 | A * | 12/1960 | Jackson | B63B 22/24 | 102/395 |
| 3,416,450 | A * | 12/1968 | Ballreich | F42B 3/117 | 102/205 |
| 3,554,127 | A * | 1/1971 | Becker | F42B 27/00 | 102/487 |
| 3,575,111 | A * | 4/1971 | Richardson | F42B 4/26 | 102/204 |
| 3,908,550 | A * | 9/1975 | Beatty | F42B 4/26 | 102/334 |
| 3,942,445 | A * | 3/1976 | Baker | C06C 9/00 | 102/205 |
| 4,285,277 | A * | 8/1981 | Lerman | F42C 14/02 | 102/223 |
| 4,846,067 | A * | 7/1989 | Martin | F42B 3/117 | 102/275.6 |
| 4,932,329 | A * | 6/1990 | Logie | F42B 12/50 | 102/482 |
| 5,313,888 | A | 5/1994 | Martin | | |
| 2006/0278115 | A1* | 12/2006 | Juy | F42B 8/26 | 102/487 |

* cited by examiner

FUSE ASSEMBLY FOR A MUNITION

BACKGROUND

Pyrotechnic grenades of a variety of types are known, including flash grenades and smoke grenades. Smoke grenades generate a volume of smoke after initiation, and are principally used for signalling, and concealment of movement. They are used in a variety of contexts, including military, maritime (as distress flares) and recreational (for example, in battle simulation or "paintball" or "airsoft" games).

Typical design consists of a container with emission holes to allow smoke release when the grenade is ignited. The filler consists of smoke composition (typically potassium chlorate, lactose, and a dye). The reaction is exothermic, and considerable heat is generated during smoke release.

To use the grenade, the smoke mixture must be ignited, and this is generally achieved by means of a fuse. Types of fuses known in the art include friction strike fuses, in which a primer button is provided with a cap whose outside surface is partially coated with a friction-ignitable material. This friction-ignitable material is in turn covered with a removable cover provided with a striking plate or section covered with red phosphorus or an abrasive material. To ignite this type of device the user must first remove the cover from the friction-ignitable material. The end of the cover with the scratch material is then rubbed or struck quickly across the friction-ignitable material to ignite the flare mixture.

A further type of ignition mechanism is generally referred to as a pull-wire. One type consists of an elongated tube, having an inner wall coated with friction-ignitable material. A pull-wire runs through the channel and the free end projects out of one end of the tube, while at the other end the wire is attached to a plunger coated with scratch material. To operate the fuse, the user pulls the free end of the wire, causing the plunger to travel down the tube, causing frictional force between the plunger and the friction-ignitable material, and combustion of the latter. This, in turn, ignites a primer charge and ultimately the smoke mixture.

A further type of pull-wire igniter includes a wire which passes through a hole in a metal cup, with one end of the wire coiled or bent adjacent to the open side of the cup, and the other protruding out of the cup and attached to a ring-pull. The cup contains an ignition mixture. On pulling the ring-pull, the wire is pulled through the hole in the ignition mixture and cup straightening it and generating heat through friction, which ignites the ignition mixture.

A problem with both the strike ignition and pull-wire type fuses is that the device is in the hand of the operator when ignition commences. This is a burn hazard for the user, and additionally it may be undesirable in certain circumstances for smoke generation to commence at the location of the operator, who may for tactical reasons desire to throw the device so as not to disclose their location.

One solution to this problem is shown in FIG. 1.

The fuse mechanism in the grenade (10) includes a safety pin (11) inserted through a hole (12). The safety pin (11) in the hole (12) holds a safety lever (13) against the side of the grenade body (14). The safety lever (13) in position against the body (14) of the grenade (10) holds a spring loaded lever (15) against the top of the canister containing the smoke material (16). The spring loaded lever (15) is attached to one end of a pull-wire (20), the other end of which forms a coil (17) inside metal cup (18). Metal cup (18) contains a pyrotechnic composition, typically a chlorate/fuel mixture.

Removal of the safety pin (11) permits release of the safety lever (13), which then has to be held against the body (14) of the grenade (10) to prevent ignition. Once the grenade (10) is thrown, the pressure on the safety lever (13) is released, and the spring loaded lever (15) is forced to rotate on its axis by the spring (19), throwing off the safety lever (13). The spring loaded lever (15) then exerts an upward force on the pull-wire (20), forcing the coiled portion (17) through an aperture in the metal cup, which generates heat and in turn ignites the friction-ignitable material and ultimately the smoke material (16).

Although this type of fuse overcomes certain limitations inherent in pull-wire type fuses, it nevertheless has drawbacks. In particular, the force exerted on the pull-wire can be hampered by the safety lever, leading to unreliable ignition. Further, the spring exerts a significant upforce on the safety lever, which can result in a significant "kick" when the primed grenade is thrown, leading to inaccuracies in deployment and potential ignition failures.

In addition, as soon as the safety lever (13) starts to move away from the body of the grenade (14), the spring loaded lever (15) also starts to rotate. If the safety lever (13) is released slowly, the spring loaded lever (15) also rotates slowly pulling the pull-wire (20) with insufficient speed or force to generate sufficient friction to ignite the friction-ignitable material within the metal cup (18). This causes a significant unreliability in the ignition of the smoke material (16).

The present invention seeks to overcome these and other limitations of prior art devices.

SUMMARY OF THE INVENTION

Figure 1:
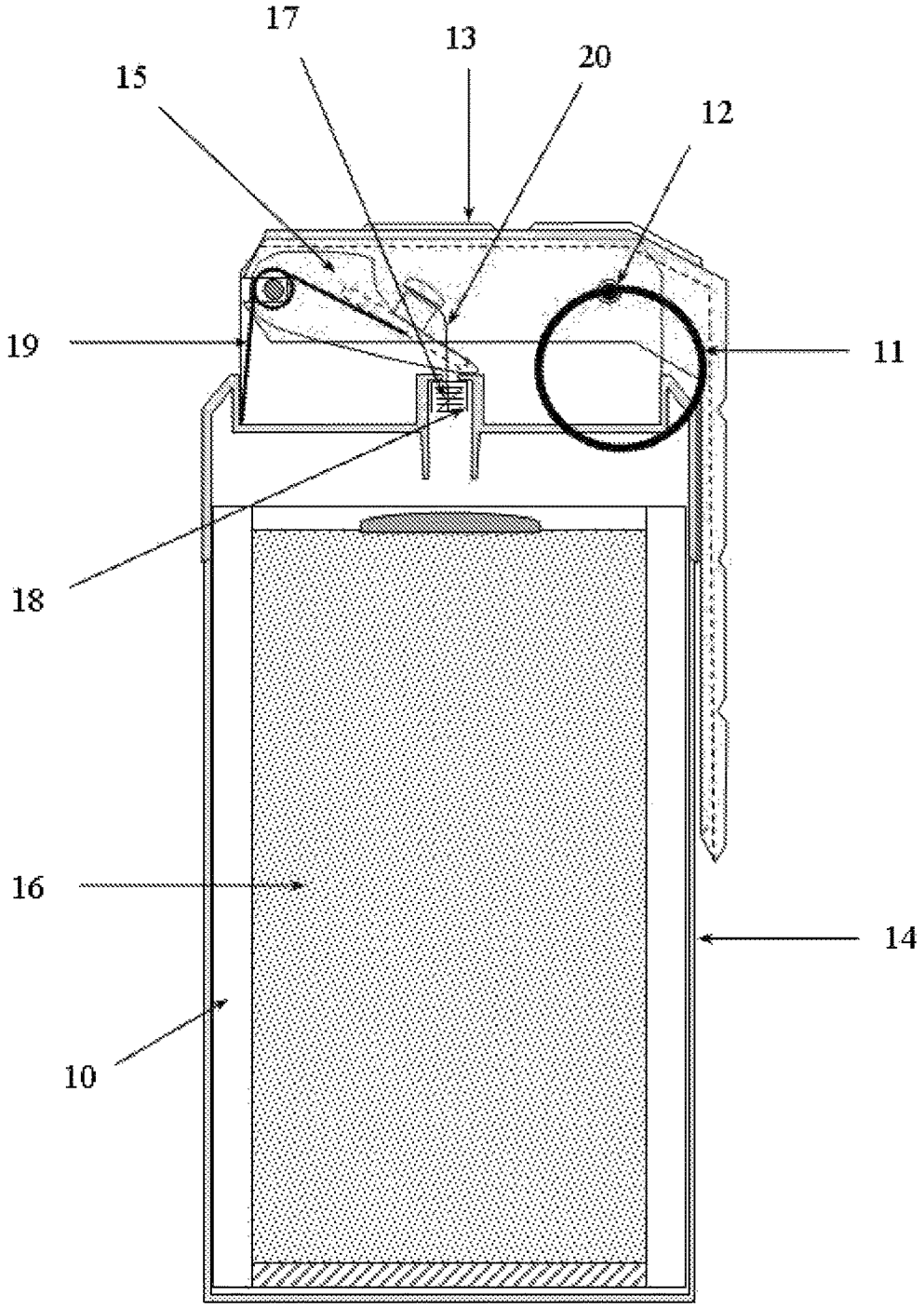
FIG. 1 is a smoke grenade of known type.

According to a first embodiment, there is provided a fuse assembly for igniting a charge, comprising a) a fuse housing (28);

b) a safety lever (21) pivotally attached to the fuse housing (28), said safety lever (21) having a handle portion (25) and a cammed portion (22) generally disposed about a first pivot point (23);

c) a spring loaded striker lever (31) pivotally attached to the fuse housing (28), having a pivot point (32) provided towards a first end (33) and a second free end (34), the striker lever (31) being adapted to receive the pull-wire (36) of a pull-wire igniter;

wherein in a first configuration, the free end (34) of the spring loaded striker lever (31) is in contact with the cammed portion (22) of the safety lever (21) holding the striker lever (31) in position, such that rotation of the safety lever (21) away from the fuse housing (28) reduces contact between the free end (34) and the cammed portion (22), allowing the spring loaded striker lever (21) to rotate away from the fuse housing (28).

DETAILED DESCRIPTION

Figure 2:
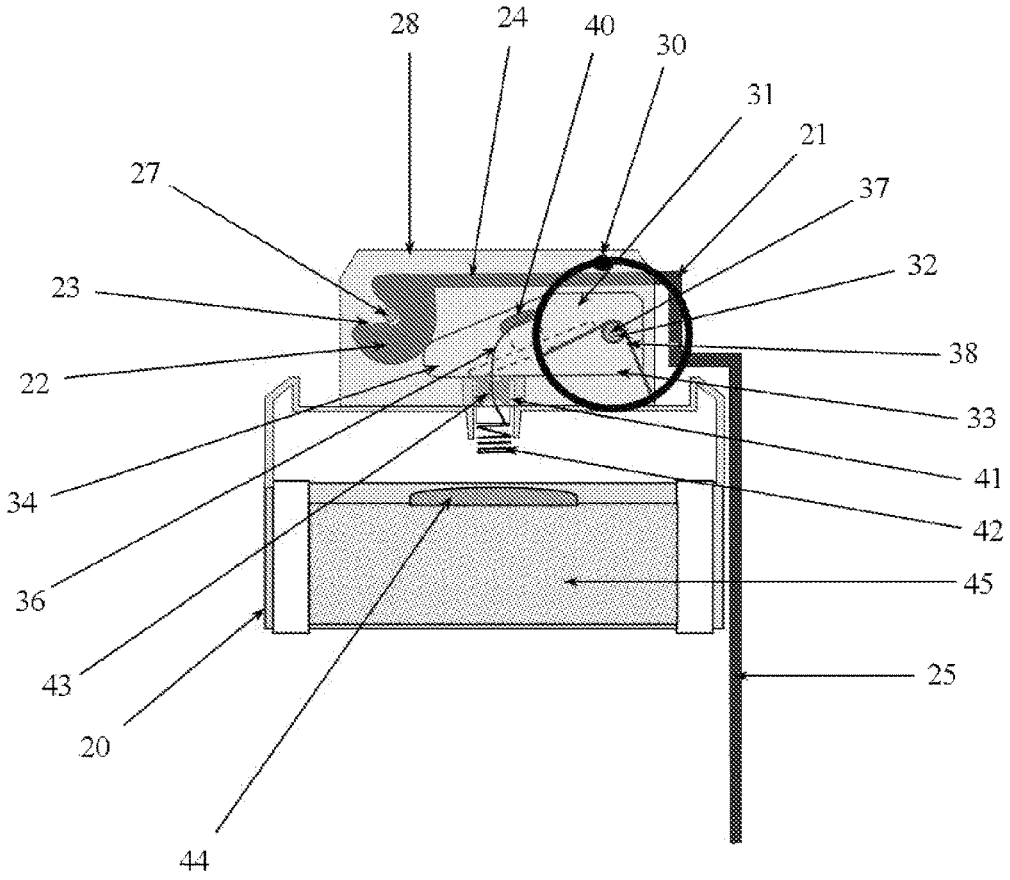
FIG. 2 is a section view of a fuse according to one embodiment of the invention, prior to use.

FIG. 2 shows an embodiment of the invention, with the fuse assembly attached to a munition (20). Safety lever (21) includes a cammed portion (22) generally disposed about a seat (23). Extending horizontally from the cammed portion is connecting arm (24), which connects to a handle (25), which is generally perpendicular to the connecting arm (24).

The safety lever (21) is pivotally attached via pivot (27) sitting within seat (23) to fuse housing (28). The safety lever (21) is held in position by safety pin (30), which passes through the fuse housing (28), and prevents rotation of safety lever (21) about pivot (27).

Striker lever (31) is of generally elongate form, and is provided with a pivot hole (32) towards a first pivoted end (33) and a second free end (34). In the embodiment shown, second free end (34) has a rounded profile.

The striker lever (31) is pivotally attached via pivot (37) passing through pivot hole (32) to fuse housing (28). A torsion spring (38) is wound about pivot (37), and in the configuration shown the torsion spring (38) is held under compression. Striker lever and safety lever (21) pivot about separate points, and in opposite directions. The second free end (34) of the striker lever (31) is in contact with cammed portion (22) of the safety lever, which prevents rotation of striker lever (31) in an upwards direction.

A metal wire (36) is attached at one end to a stud (40) provided on the upper surface of striker lever (31). The wire passes through a hole in a metal cup (41), and has a coiled portion (42) which sits within or below the metal cup (41). Metal cup (41) contains a pyrotechnic mixture (43). The body of the device to which the assembly is attached contains a primer composition (44) and pyrotechnic charge (45).

In use, the operator holds handle (25) against the body of the munition (20), and removes the safety pin (30). The munition is thrown or released, which releases the restraining pressure on handle (25).

Figure 3:
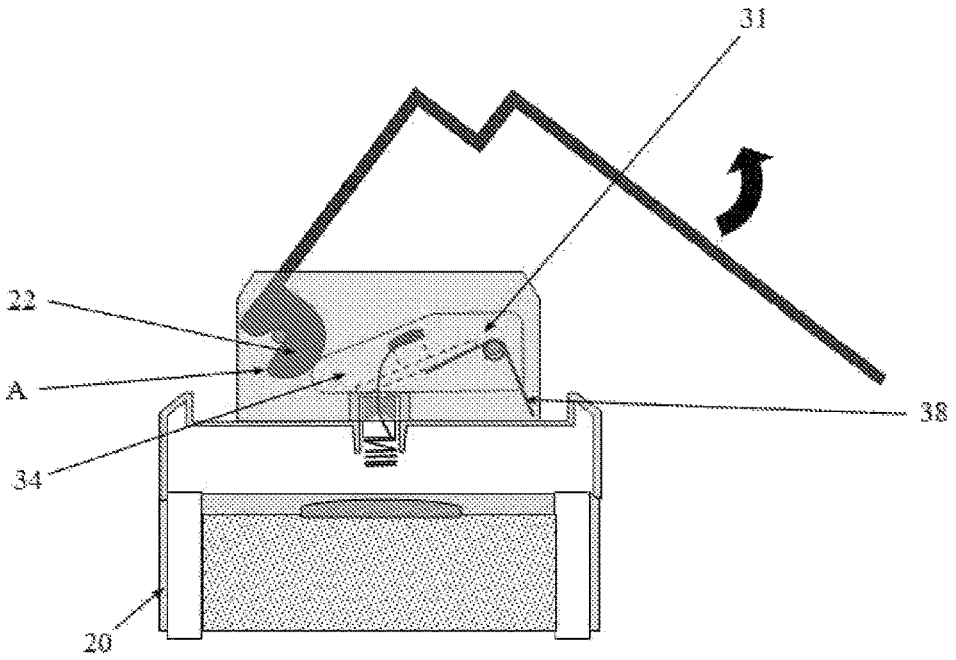
FIG. 3 is a section view of a fuse according to one embodiment of the invention, immediately after use.

Removal of the safety pin (30) and release of the handle (25) enables deployment of the fuse assembly, as shown in FIG. 3.

Spring-loaded striker lever (31) is urged upwards by the force of torsion spring (38). Contact between the free end (34) of the striker lever (31) exerts a rotational force on cammed portion (22). The safety lever (21) rotates away from the body of the munition (20). Rapid upward movement of the striker lever (31) is prevented at this stage by contact of the free end (34) with the cammed portion (22).

Figure 4:
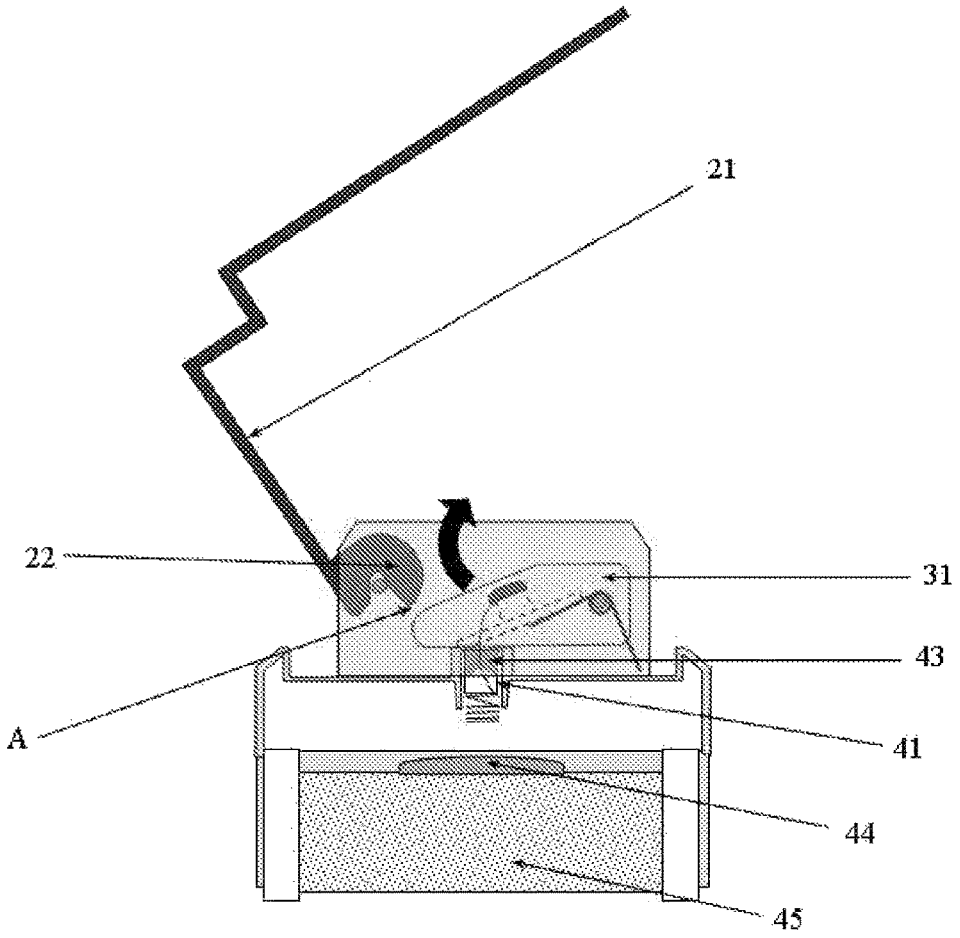
FIG. 4 is a section view of a fuse according to one embodiment of the invention, subsequently after use.

Further rotation of the safety lever (21) occurs until point A where the cammed portion (22) is no longer in contact with the striker lever. This is shown in FIG. 4.

Figure 5:
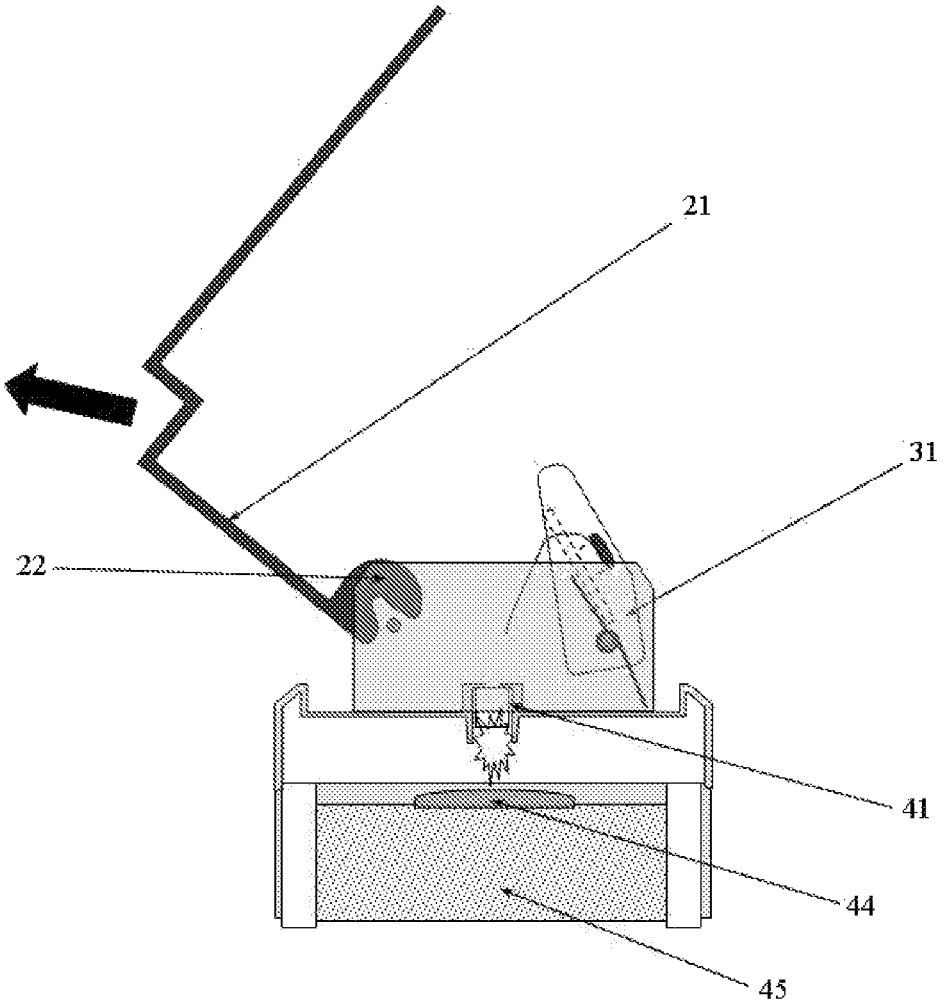
FIG. 5 is a section view of a fuse according to one embodiment of the invention, subsequently after use.
Figure 6:
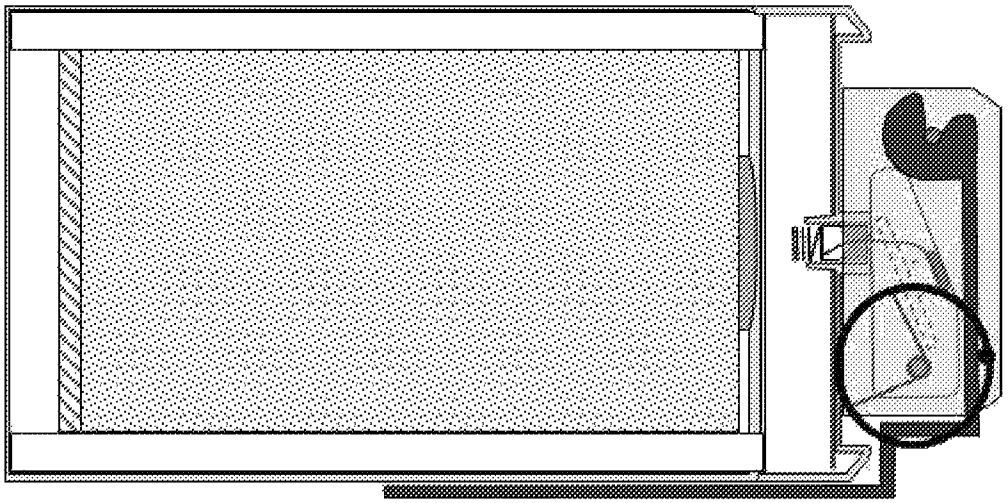
FIG. 6 is a section view of a munition, incorporating a fuse according to one embodiment of the invention.

Ultimately, once the safety lever (21) has rotated beyond a certain extent, the free end of the striker lever (31) is no longer in contact with the cammed portion (22), and the striker lever is urged rapidly away from the body of the munition (20). This pulls the coiled portion of the wire through the hole in the metal cup (41). The heat generated causes the pyrotechnic composition (43) to ignite, and ultimately results in ignition of the primer (44) and pyrotechnic charge (45). The safety lever (21) is able to detach from the device. This is shown in FIG. 5.

It has been found that the cammed profile of the safety lever results in the constant contact between cam and striker lever (31) during the rotation of the safety lever (21), holding the striker lever (31) in position until the point when the striker lever (31) is suddenly released. The sudden and rapid release of the striker lever (31) rather than gradual release as seen in known devices allows for greater heat generation through friction which allows superior ignition of the fuse mechanism and a lower proportion of fuse mechanism failures and a lower "kick" experienced by the operator. This invention has the added advantage that the rapid release of the striker lever at point A is not dependant on deployment of how the device is deployed, resulting in fewer operator error malfunctions of the munitions.

The fuse is applicable to any type of munition, particularly those which are thrown by hand. Accordingly, the invention also relates to a munition featuring a fuse of the type described. Such munitions include smoke devices, flash devices, explosive devices, tear gas devices, and whistle or other noise-making devices.

The invention claimed is:

1. A fuse assembly for igniting a charge, comprising a) a fuse housing (28);

b) a safety lever (21) pivotally attached to the fuse housing (28), said safety lever (21) having a handle portion (25) and a cammed portion (22) generally disposed about a first pivot point (23);

c) a spring loaded striker lever (31) pivotally attached to the fuse housing (28), having a second pivot point (32) provided towards a first end (33) and a second free end (34), the striker lever (31) being adapted to receive the pull-wire (36) of a pull-wire igniter;

wherein in a first configuration, the free end (34) of the spring loaded striker lever (31) is in contact with the cammed portion (22) of the safety lever (21) holding the striker lever (31) in position, such that rotation of the safety lever (21) away from the fuse housing (28) reduces contact between the free end (34) and the cammed portion (22), allowing the spring loaded striker lever (21) to rotate away from the fuse housing (28).

2. A fuse assembly according to claim 1, wherein the striker lever (31) is provided with a pull-wire (36).

3. A fuse assembly according to claim 2, wherein said pull-wire (36) extends through a hole in a metal cup containing a pyrotechnic mixture (43).

4. A fuse assembly according to claim 1, wherein the cammed portion (22) is generally in the form of a spiral disposed about the pivot point (23).

5. A fuse assembly according to claim 1, wherein the cammed portion (22) features a step.

6. A fuse assembly according to claim 1, wherein there is provided a safety pin (30).

7. A fuse assembly according to claim 1, wherein the spring loaded striker lever (31) is provided with a torsion spring (38).

8. A fuse assembly according to claim 1, wherein the second free end (34) of spring loaded striker lever (31) is rounded in profile.

9. A munition provided with a fuse assembly as claimed in claim 1.

10. A munition according to claim 9 which is adapted to be thrown.

11. A munition according to claim 9 which is a pyrotechnic.

12. A munition according to claim 11 which is a smoke generating device.

* * * * *